US012098540B2

(12) United States Patent
Warren et al.

(10) Patent No.: US 12,098,540 B2
(45) **Date of Patent: *Sep. 24, 2024**

(54) METHOD AND KIT FOR INSTALLATION OF SIDING PANELS

(71) Applicant: Ply Gem Industries, Inc., Cary, NC (US)

(72) Inventors: Jeremy Earl Warren, Shawnee, KS (US); Danny R. Parks, Blue Springs, MO (US); Bryan Keith Beasley, Kearney, MO (US); Kaleb Hahn, Kansas City, MO (US)

(73) Assignee: Ply Gem Industries, Inc., Cary, NC (US)

( * ) Notice: Subject to any disclaimer, the term of this patent is extended or adjusted under 35 U.S.C. 154(b) by 215 days.

This patent is subject to a terminal disclaimer.

(21) Appl. No.: 17/805,636

(22) Filed: Jun. 6, 2022

(65) Prior Publication Data

US 2022/0298781 A1 Sep. 22, 2022

Related U.S. Application Data

(63) Continuation-in-part of application No. 17/195,124, filed on Mar. 8, 2021, now Pat. No. 11,352,798, (Continued)

(51) Int. Cl.
*E04B 1/68* (2006.01)
*E04F 13/08* (2006.01)

(52) U.S. Cl.
CPC ..... *E04B 1/6803* (2013.01); *E04F 13/0866* (2013.01); *E04F 13/0894* (2013.01)

(58) Field of Classification Search
CPC ..... E04B 1/6803; E04F 13/0887; E04F 13/0864; E04F 13/0825; E04F 13/21; E04F 13/24; E04F 13/26; E04F 13/0801
See application file for complete search history.

(56) References Cited

U.S. PATENT DOCUMENTS 4,788,808 A * 12/1988 Slocum ..... E04F 13/0864 52/309.8
5,274,979 A * 1/1994 Tsai ..... E04F 13/0878 52/610

(Continued)

FOREIGN PATENT DOCUMENTS

CA 2484792 4/2005
CA 2576987 4/2005

(Continued)

OTHER PUBLICATIONS

Canadian Application No. 3,048,755, Office Action dated Jul. 13, 2021, 3 pages.

(Continued)

*Primary Examiner* — Jessie T Fonseca
(74) *Attorney, Agent, or Firm* — Lathrop GPM LLP; Robert J. Lambrechts

(57) ABSTRACT

A method and kit for installing siding panels to an exterior surface of a structure. The method and kit are directed to the positioning of a mending plate between the ends of horizontally adjacent siding panels. Lines of an adhesive are applied to the mending and the mending plate is disposed approximately midway between the ends of each of the adjacent first and second siding panels. Pressure is applied to the ends of the siding panels that are disposed over the respective portions of the mending plate thereby uniformly spreading the adhesive across the back surface of the siding panel and the mending plate to enhance the chemical bond of the adhesive once fully cured.

21 Claims, 13 Drawing Sheets

Related U.S. Application Data which is a continuation-in-part of application No. 16/504,406, filed on Jul. 8, 2019, now Pat. No. 10,941,576.

(60) Provisional application No. 62/694,780, filed on Jul. 6, 2018.

(56) References Cited

U.S. PATENT DOCUMENTS

| | | | | |
|---|---|---|---|---|
| 5,425,210 | A * | 6/1995 | Zafir | E04C 2/292 52/592.4 |
| 5,553,434 | A * | 9/1996 | Tamura | E04D 3/38 52/712 |
| 5,598,677 | A * | 2/1997 | Rehm, III | E04D 1/2942 52/553 |
| D448,865 | S * | 10/2001 | Manning | D25/139 |
| D450,138 | S * | 11/2001 | Barber | E04F 13/0864 D25/139 |
| 6,393,792 | B1 * | 5/2002 | Mowery | E04F 13/18 52/549 |
| D471,292 | S * | 3/2003 | Barber | D25/141 |
| 7,040,067 | B2 | 5/2006 | Mowery et al. | |
| 7,188,454 | B2 | 3/2007 | Mowery et al. | |
| 7,698,864 | B2 * | 4/2010 | Justice | E04F 13/185 52/529 |
| 7,721,488 | B1 * | 5/2010 | Bennett | E04F 13/0864 52/302.6 |
| 7,748,190 | B1 * | 7/2010 | Loper | F16B 15/0046 52/715 |
| 7,779,594 | B2 | 8/2010 | Mowery et al. | |
| 8,381,472 | B1 * | 2/2013 | Fleenor | E04F 13/0825 52/459 |
| 8,387,325 | B2 | 3/2013 | Mullet et al. | |
| 9,309,677 | B1 * | 4/2016 | Anic | E04F 13/24 |
| 10,900,221 | B2 * | 1/2021 | McEndree | E04F 21/1855 |
| 2003/0032351 | A1 | 2/2003 | Horner, Jr. et al. | |
| 2005/0193674 | A1 * | 9/2005 | Hatkoff | E04F 13/0864 52/561 |
| 2006/0042183 | A1 * | 3/2006 | Benes | E04F 13/0864 52/741.1 |
| 2008/0008880 | A1 * | 1/2008 | Walda | E04F 13/0889 428/343 |
| 2008/0216430 | A1 * | 9/2008 | Gleeson | E04F 13/0864 52/506.1 |
| 2008/0318019 | A1 * | 12/2008 | Walda | E04F 13/0889 428/220 |
| 2009/0064599 | A1 * | 3/2009 | Bennett | E04F 13/0864 52/60 |
| 2011/0214372 | A1 | 9/2011 | Mullet | |
| 2012/0042604 | A1 * | 2/2012 | Walda | E04F 21/1855 52/741.4 |
| 2012/0096790 | A1 * | 4/2012 | Wilson | E04F 13/08 52/302.1 |
| 2014/0013696 | A1 * | 1/2014 | Murphy | E04F 13/0869 52/489.1 |
| 2016/0160497 | A1 * | 6/2016 | Randlett | E04F 13/0839 52/61 |
| 2016/0319555 | A1 * | 11/2016 | Norwood | E04F 13/072 |
| 2017/0211280 | A1 * | 7/2017 | Hubbard | E04F 13/0875 |
| 2019/0203483 | A1 * | 7/2019 | Colyn | E04F 13/0864 |

FOREIGN PATENT DOCUMENTS

| | | |
|---|---|---|
| CA | 2571910 | 6/2007 |
| CA | 2695884 | 9/2011 |
| CA | 2958313 | 8/2017 |
| JP | 09013626 | 1/1997 |
| WO | 2010050994 | 5/2010 |

OTHER PUBLICATIONS

Prodigy Insulated Siding Product, Alside Prodigy, Prodigy Vinyl Siding: Where Comfort Meets Performance, http://cdn.alside.com/media/14316/siding-trim-and-accessory-catalog.pdf, dated Sep. 2012.

* cited by examiner

METHOD AND KIT FOR INSTALLATION OF SIDING PANELS

RELATED APPLICATIONS

This application claims the benefit of priority to U.S. application Ser. No. 17/195,124 filed on Mar. 8, 2021, now U.S. Pat. No. 11,352,798, U.S. application Ser. No. 16/504,406 filed on Jul. 8, 2019, now U.S. Pat. No. 10,941,576 and U.S. Provisional Application No. 62/694,780 filed Jul. 6, 2018.

TECHNICAL FIELD

Disclosed herein are a method and kit for the installation of a siding panels to the exterior surface of a building structure that eliminates, or at least substantially reduces, the potential for gap formation between horizontally adjacent panels. The gap formation due primarily to temperature fluctuations that cause the siding panels to shorten and pull away from one another.

BACKGROUND

Siding panels serve a two-fold objective of protecting a structure from damaging elements such as sunlight, moisture, hail and strong winds as well as providing an aesthetically appealing external appearance to the structure. The siding must protect the structure from blisteringly hot sunlight that can induce thermal expansion and unattractive buckling of the siding. Panel siding must also minimize the infiltration of moisture from heavy wind-blown rains and should moisture find its way behind the siding an exit route must be available to avoid the growth of mold and to prevent the rotting of any cellulosic structural elements such as plywood siding and structural framing or the oxidation of ferrous support members.

In addition to the capacity to withstand thermal loading, hail impacts and provide for moisture penetration, well designed and installed exterior siding must be capable of withstanding high wind loadings. Siding panels that allow wind to gain access to the back surface, or the surface adjacent to the building structure, can experience tremendous loads capable of literally peeling the siding from the building. Consequently, the ability to seal both the upper and lower edges of the siding panel against panel courses above and below is critical to protecting the panels from the effects of strong wind loads.

Fire resistant siding is more important than ever, especially in areas prone to wildfires such as in Colorado, Arizona and California. One of the best ways to protect a home against fire damage is to use Class-A fire rated siding. Using Class-A, fire rated products reduce risk to the homeowners and potentially reduces insurance coverage costs.

Numerous siding panel designs exist in the marketplace; however, most are either lacking in some functional aspect, such as gap formation between horizontally adjacent panels due to expansion and contraction of the siding panel due to temperature variations, or are prohibitively expensive, difficult to install or require extensive training and costly tools for proper installation. Moreover, thermoplastic siding panels that are darker in color tend to be more adversely impacted with warpage due to temperature increases. The consequence of such involved training and the acquisition of expensive tools is that these costs must ultimately be passed onto the consumer for the installer to experience a profit from her labors.

SUMMARY

Disclosed herein is a siding panel configuration that includes a thermoplastic skin cross-section or profile, a panel stiffening material, a method for installing the panels and finally a kit disclosing the components necessary to effectuate a panel installation that eliminates, or at least substantially reduces, the formation of gaps between horizontally adjacent panels due to thermal expansion and contraction.

The siding panel disclosed herein includes a cured resin stiffening material backing that enhances the rigidity of the thermoplastic panel and protects the structure to which the siding panel is applied from damaging elements such as sunlight, moisture, hail and strong winds as well as providing an aesthetically appealing external appearance to the structure. The panel with resin stiffening material backing is highly resistant to thermal expansion since the resin covers essentially the entire back surface of the panel and therefore avoids the formation of any areas of the siding member that are uncovered by the stiffening material that could result in differences in thermal expansion of the siding member under heat load. In a preferred embodiment the siding panel comprises a resin foam applied to the backside of a thermoplastic panel the union of which produces a siding panel with highly desirable weatherable and physical parameters including resistance to deformation from impacts by hail and other projectiles.

The disclosed siding panel comprises a panel with a front face and a back face along with a top edge and a bottom edge. As is typical with siding panels, the upper panel course engages with the panel course below and the following discussion details the utilization of multiple courses of panels interlocking with one another on the side of a building. The panel disclosed herein significantly lessens the potential for damage to the siding posed by wind, hail, impacts from objects, rain, sun and complex installation procedures with a simple design that requires only minimal training and no sophisticated tools to properly install.

It is an object of the method disclosed herein to detail the process for installing the panels that incorporates the use of an adhesive applied to a mending plate with the mending plate being disposed beneath the opposing ends of horizontally adjacent panels.

It is another object of the kit disclosed herein to convey the components necessary to effectuate the installation of the siding panels to eliminate, or greatly reduce, the potential for formation of a gap between horizontally adjacent panels ends due to thermal expansion and contraction.

It is another object of the siding member disclosed herein to bond, without an adhesive, a resin based foamed component to the rear surface of a siding panel wherein the fabricated panel exhibits enhanced structural rigidity and is thermally stable even under the most extreme solar heat loads.

It is another object of the siding member disclosed herein to provide an exterior siding member that is lightweight and easy to install with nominal training.

It is another object of the siding member disclosed herein to provide an exterior siding member that is tough, durable and capable of withstanding impacts from, for example, large diameter hail.

It is another object of the siding member disclosed herein to provide an exterior siding member that is weatherable and does not require painting or caulking maintenance.

It is another object of the siding member disclosed herein to limit panel warpage due to increased temperature and in particular for thermoplastic panels that are darker in color.

Various objects, features, aspects and advantages of the disclosed subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Figure 1:
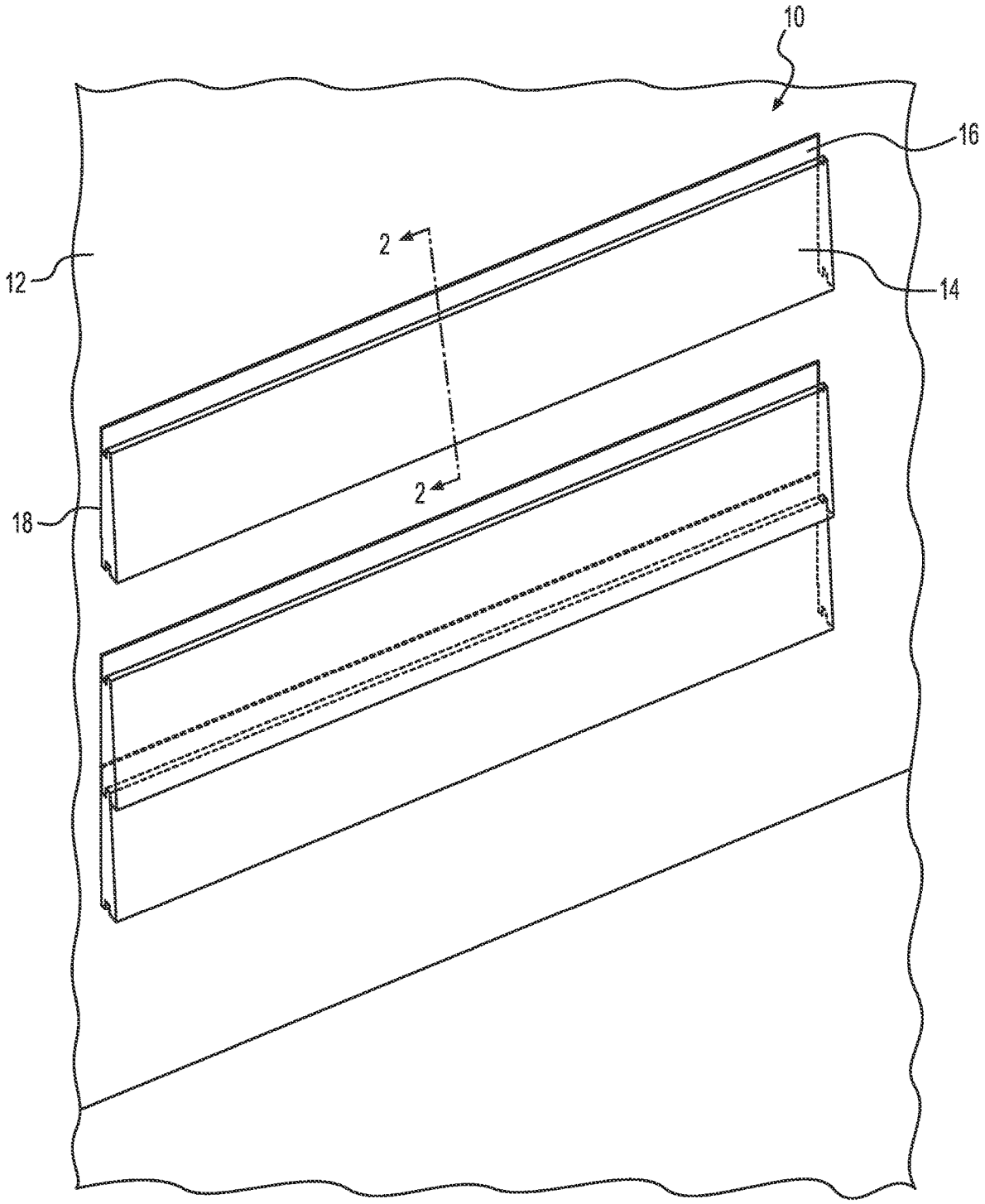
FIG. 1 illustrates a perspective view of an embodiment of a plurality of siding members in process of attachment to a structure.
Figure 2:
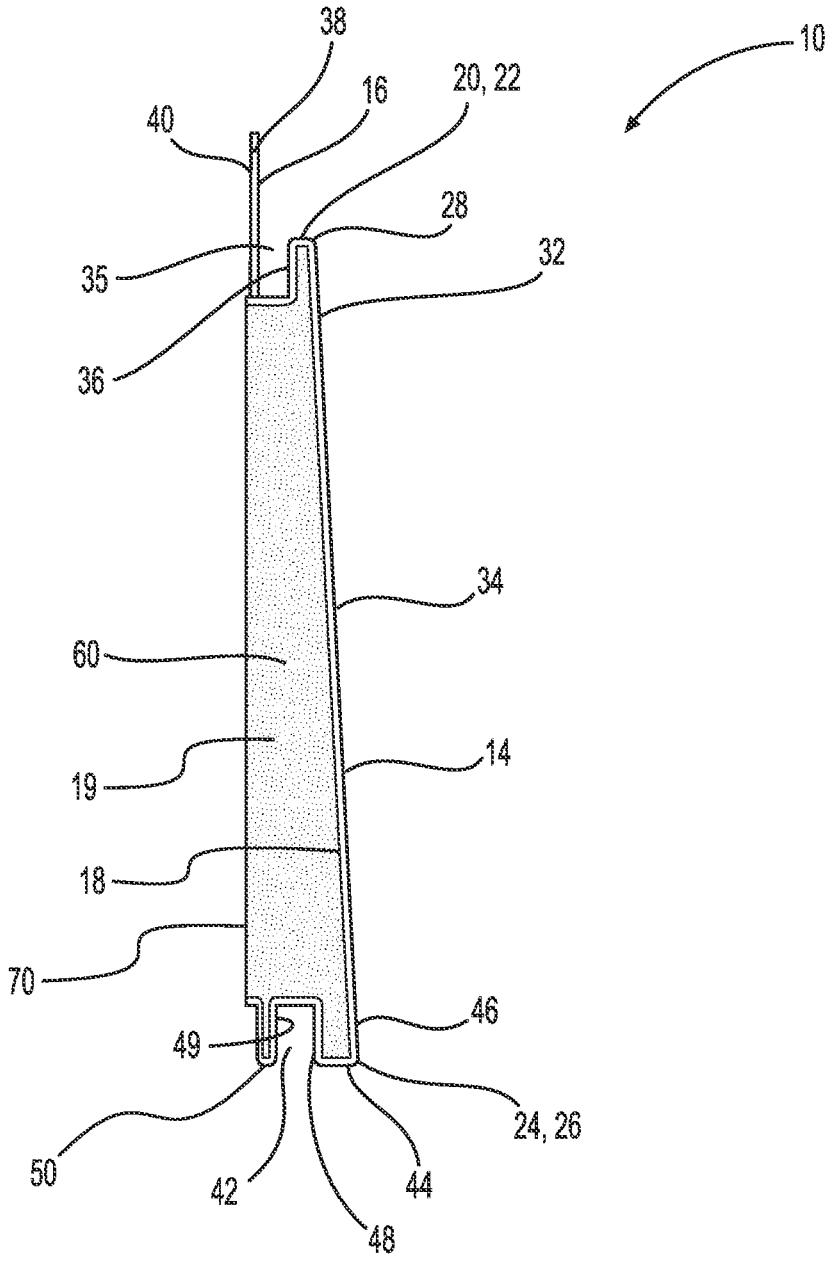
FIG. 2 illustrates a cross-sectional view, along line 2-2 of FIG. 1 of an embodiment of a siding member as disclosed herein.

Disclosed herein and as shown at FIG. 1 is a perspective view of several siding panels in preparation for attachment to a structure. FIG. 2 is a cross-sectional view of FIG. 1 along sectional line 2-2 of a siding member 10 for covering an exterior of a structure 12. The siding member 10 includes a thermoplastic siding panel 14 having a nail hem 16 and a rear face 18, wherein the rear face 18 and other features of the panel form a receptacle 19 configured to retain a stiffening material sprayed or poured therein. The siding member 10 further utilizes a locking feature 20 located on the top edge 22 of the siding panel 14 and a mating feature 24 on the bottom edge 26 of the siding panel 14.

The locking feature 20 comprises an extension 28 located at the top edge 22. The front face 32 of the extension 28 is co-extensive with the front face 34 of the siding panel 14 and projects upwardly in the range from about ¼ inch to 1 inch leaving a longitudinally extending channel 35 between the back face 36 of the extension 28 and the front face 38 of the nail hem 16.

The bottom edge 26 of the panel 14 is complementary to the top edge 22 as will be discussed in greater detail below. A channel 42 is formed into the bottom edge 26 that includes a first downward projection 44, the front edge 46 of the first downward projection 44 is co-extensive with the front face 34 of the siding panel 14. The back face 48 of the downward projection 44 forms one side of the channel 42 and a second side 49 of the channel 42 is formed from a second downward projection 50 near the rear face 70 of the filled resin 60. The depth of the channel 42 is consistent with the height of the extension 28 located at the top edge 22 such that when a siding course is positioned above a lower course the extension 28 of the lower course is received into the channel 42 of the lower course creating a connection between the two panels that is resistant to water penetration and is also structurally rigid.

FIG. 2 also reveals that residing behind the siding panel 14 is a cured resin 60 that, among other attributes, structurally enhances the stiffness of the panel 14. The resin 60 in an uncured state 60A is sprayed, or poured, onto the back surface 18 of the siding panel 14 into the receptacle 19 and with placement within a mold, the resin 60A expands to cover the entire back surface 18, filling the receptacle 19 as well as the extensions 28, 44 enhancing the structural rigidity of the panel 14 thereby improving its ability to resist damage caused by excess heat during transport, and installation when mounted to the building. Additionally, as a supplemental benefit, the fully cured resin 60 reduces the rate of thermal transfer through the siding member 10 and reduces the potential for warpage due to temperature increases associated with solar radiation, particularly for darker color panels.

All the areas previously described, to include the extension 28, the first downward projection 44 and the second downward projection 50 are all filled with cured resin 60 thereby enhancing the structural stiffness of the siding member 10. This complete coverage of the back surface 18 of the siding panel 14 is critical to maintain the heat distortion resistance of siding member 10. If any of the back surface 18 is uncovered by the cured resin 60 uneven expansion of the front face 34 can occur. If uneven expansion of the front face 34 occurs then an oil-canning effect can result that significantly and adversely impacts the appearance of the panel 14.

The cured resin 60 employed for strengthening the panel 14 is preferably polyurethane; however, other resins such as polyisocyanurate, polyethylene, polypropylene, latex, melamine, expended polystyrene and syntactic foams (resin plus microspheres) are also contemplated by this disclosure. Polyurethanes are preferred for the stiffening material held in the receptacle 19 due to the polymer's versatility and safety. These polymers can be formulated to be either rigid or flexible and are typically produced from an admixture of methylene diphenyl diisocyanate, at least one polyol, water and/or a blowing agent, a catalyst and surfactants.

Amendments to the polyurethane stiffening material can include fiberglass, calcium carbonate, talc, aluminum trihydrate and graphite, among other materials, each of which is known to add specific desirable properties. The stiffening material as disclosed herein is also resistant to mold growth and termite damage. The thermoplastic siding panel 14 itself is preferably fabricated with a mineral content that is greater than 15% by mass.

The siding panel fabricated with the preferred stiffening material results is a finished product that satisfies the Underwriter's Laboratories test method for evaluation of prepared roof covering materials known as UL 2218 Standard for Impact Resistance of Prepared Roof Covering Materials. UL Standard 2218 evaluates the effect of impact from steel balls at locations on the siding selected to be most vulnerable, such as (but not limited to) edges, corners, unsupported sections and joints. The foamed panel disclosed herein earned a class 4 rating because the foamed siding panel did not crack or tear when hit twice in the same spot by a 2-inch diameter steel ball dropped from a height of twenty feet.

Figure 3:
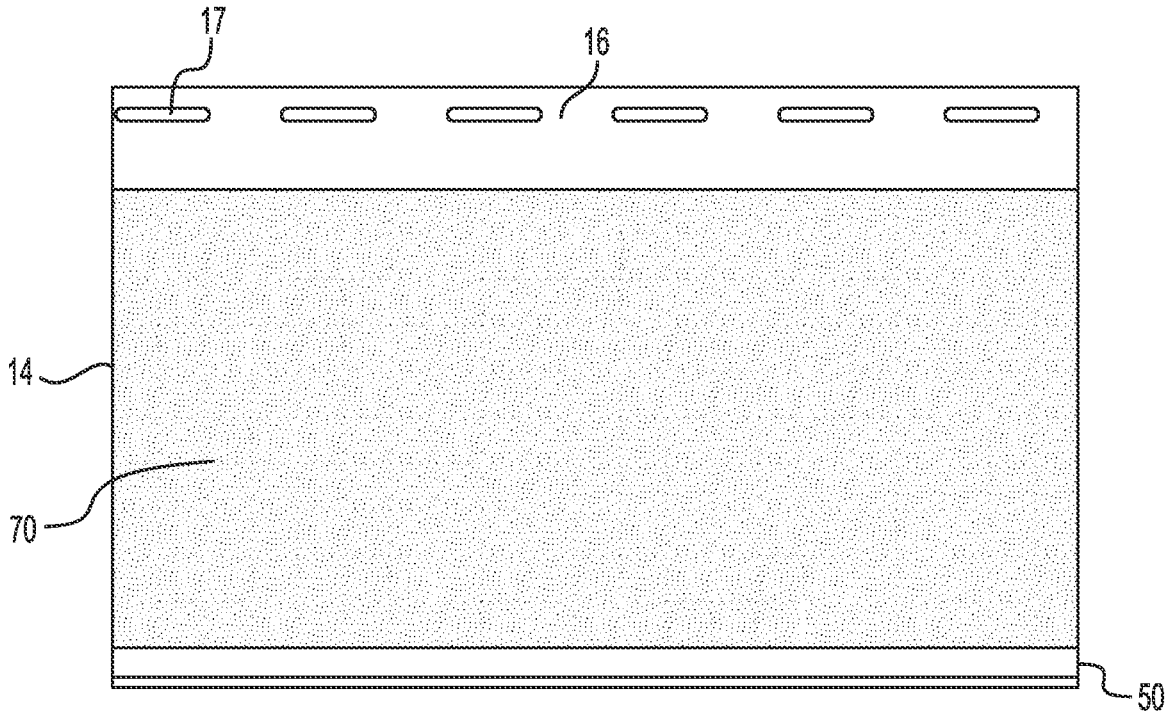
FIG. 3 illustrates a rear elevation view of an embodiment of a siding member as disclosed herein.

FIG. 3 illustrates a rear surface elevation view of the siding member 10 and details the rear surface of the nail hem 16 with slots 17 for placement of fasteners (not shown) to secure the siding member to a structure. FIG. 3 illustrates the exposed surface 70 of the cured resin 60 as well as the extension feature 50 that is used with other extension features and channel features to engage the siding member to siding members above and below.

Figure 4:
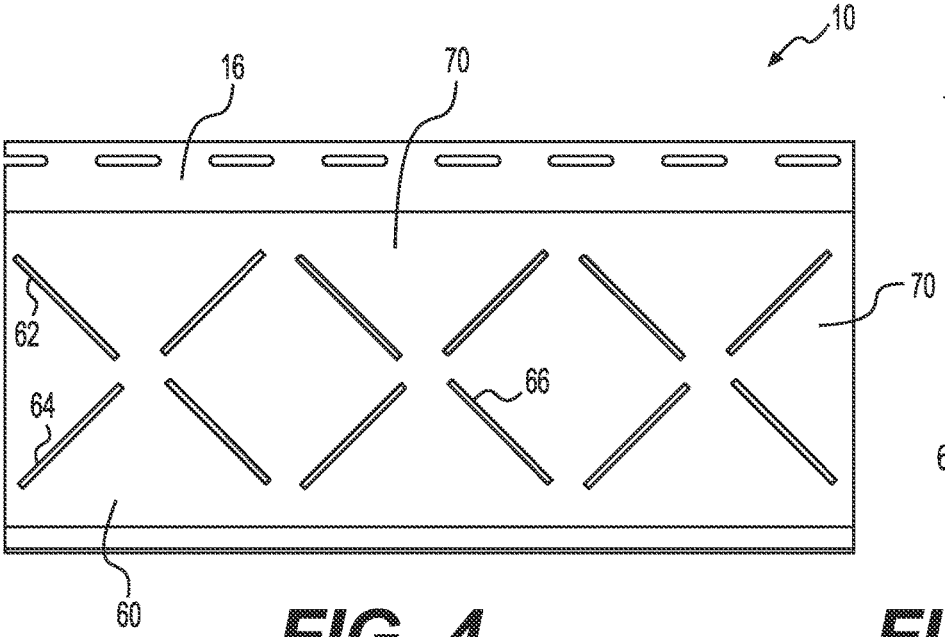
FIG. 4 illustrates rear elevation view of an embodiment of a siding member with an X-patterned rain screen as disclosed herein.
Figure 4A:
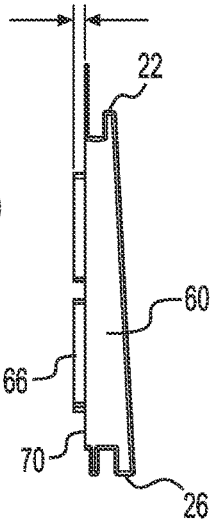
FIG. 4A illustrates a side elevation view of an embodiment of the siding member detailed in FIG. 4.

As seen in FIGS. 4-7, preferred embodiments of the siding member 10 includes at least one, and preferably several, stand-off rain screens 62. The rain screen 62 is an outwardly extending, protrusion 64 molded into the surface 70 of the cured resin 60 that extends outwardly either continuously or intermittently from the top edge 22 to the bottom edge 26 of the siding member 10. The protrusion 64 as seen in FIG. 4, may be in the form of a X-rib 66 that extends outwardly from the siding member 10 toward the building structure 12, preferably in the range of about 1.25 mm to 25 mm in height, providing space for moisture that seeps behind the siding members 10 to transit from the upper courses to ground level. Providing moisture with a gap between the surface 70 of the resin 60 lessens, and preferably prevents, the formation of mold between the siding member 10 and the structure to which the siding member is attached.

Figure 5:
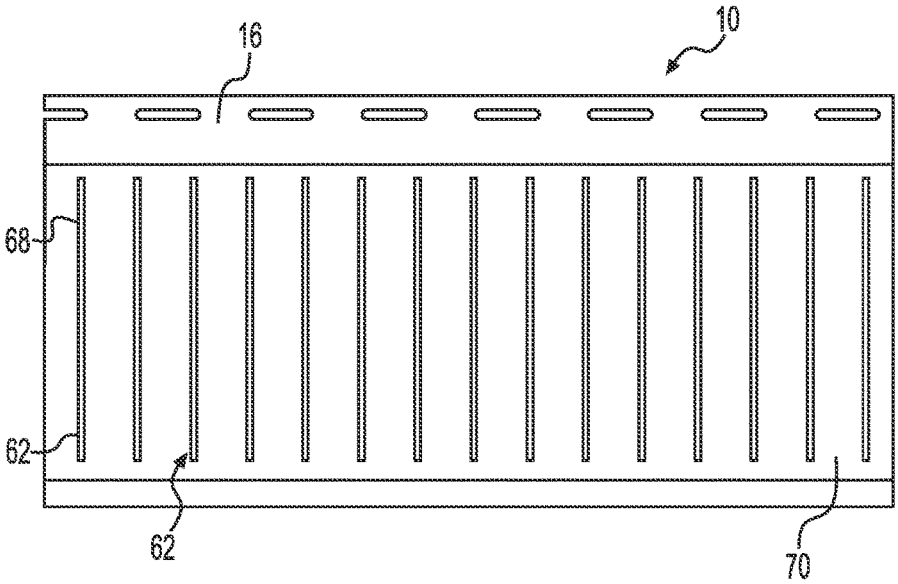
FIG. 5 illustrates a rear elevation view of an embodiment of a siding member with a vertically oriented rain screen as disclosed herein.
Figure 5A:
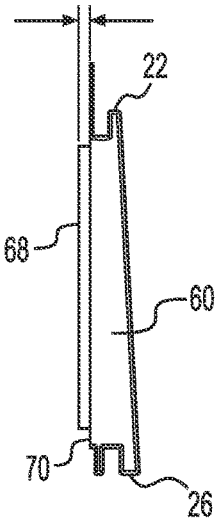
FIG. 5A illustrates a side elevation view of an embodiment of the siding member detailed in FIG. 5.
Figure 6:
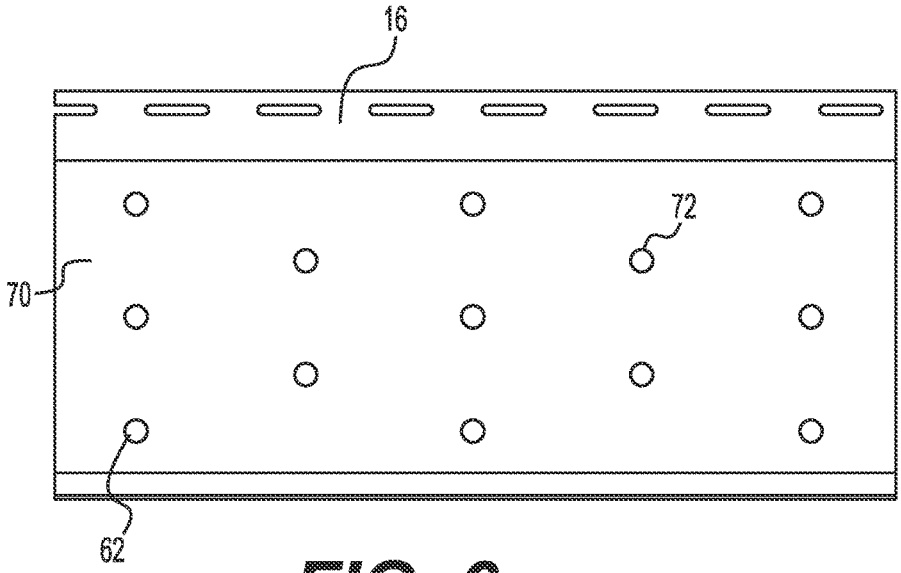
FIG. 6 illustrates a rear elevation view of an embodiment of a siding member with a dimpled rain screen as disclosed herein.
Figure 6A:
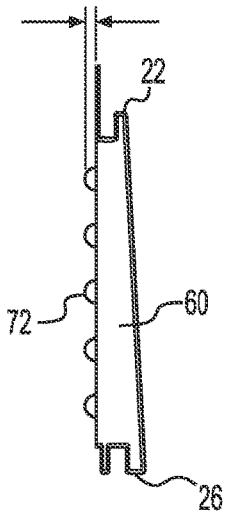
FIG. 6A illustrates a side elevation view of an embodiment of the siding member detailed in FIG. 6.
Figure 7:
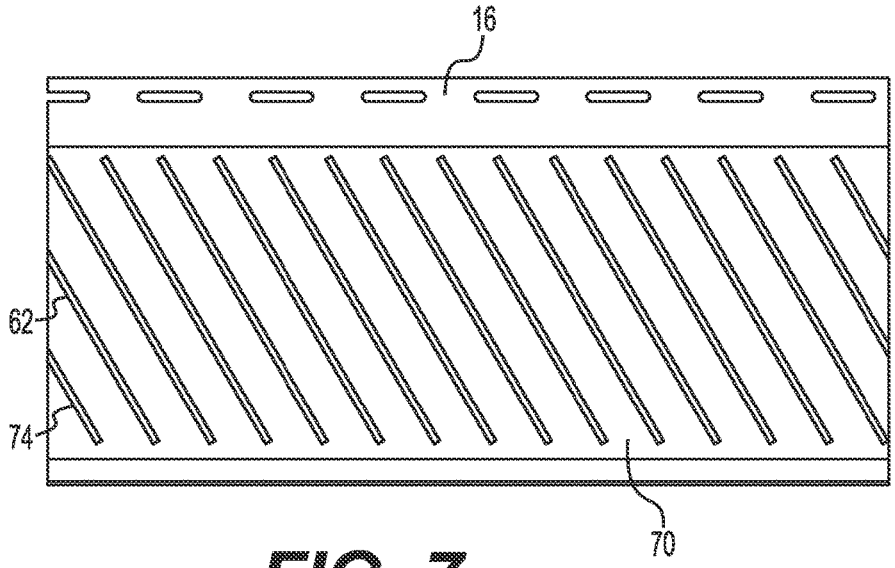
FIG. 7 illustrates a rear elevation view of an embodiment of a siding member with a slanted rain screen as disclosed herein.
Figure 7A:
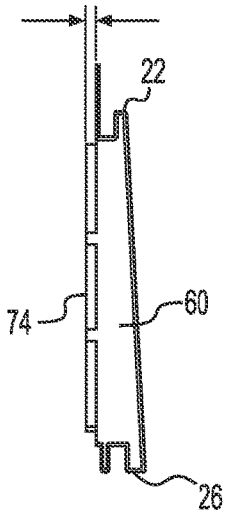
FIG. 7A illustrates a side elevation view of the embodiment of the siding member detailed in FIG. 7.

FIG. 5 provides an alternative embodiment of the rain screen 62 with vertically oriented protrusions 68 extending outwardly from the back surface 70. FIG. 6 reveals another embodiment of the rain screen 62 that includes individual circular protrusions 72 that are intermittently spaced about the back surface 70 of the panel to lift the panel back face 70 off the building surface. A fourth embodiment, as seen in FIG. 7, utilizes a rain screen 62 that employs canted protrusions 74. FIGS. 4-7 are simply representative of the many configurations of rain screens 62 that may be employed to allow moisture to move from elevation to near ground level between the panel and the building structure. Numerous other configurations are contemplated and these identified embodiments should not be construed as limiting.

An exemplary siding member 10 as disclosed herein has a distortion temperature as measured by ASTM D3679 that is greater than 165° F., a flame spread index of approximately 20 as determined by ASTM E84 and a smoke development level that is roughly 400 as determined by ASTM E84. In addition, the disclosed siding member achieved a Maximum Sustained Negative Pressure rating of 45 psf as determined by ASTM D5206 and a coefficient of linear thermal expansion that is roughly 25-30×($10^{-6}$/° K) as determined by ASTM E228. The flexural load of the disclosed siding member 10 is in the range of 150 N to 350 N as determined by ASTM D790 and the thickness of the vinyl siding panel 14 is preferably less than about 0.060 inches.

Another key term used to describe the attributes of the siding member disclosed herein is the "isocyanate index." The term isocyanate index is widely used in the polyurethane foam industry and is defined as a measure of the stochiometric balance between the equivalent weights of the isocyanate materials on the one side and the water and polyol equivalent weights on the other side. An index of 100 indicate that both equivalents are equal or balanced. The siding member disclosed herein utilizes an over-indexed (greater than one hundred) stiffening material, preferably polyurethane, with an isocyanate index of less than 150 but greater than one hundred yielding a rigid backing. This over-indexing contributes to increased dimensional stability and consistency of other properties. Indexes below one hundred for foams and elastomers yield improvements in ductility and flexibility.

As the siding members gain more panel height, also known in the industry as "exposure" or "reveal," the panels are more likely to experience warpage, principally seen in the longitudinal extent, as the ambient temperature increases. This propensity to undergo warping once the panel temperatures exceeds about 110° F. is especially problematic as the panel exposure exceeds five inches. Panels that have greater than five inches of exposure are experiencing greater sales and efforts to reduce or eliminate warpage are therefore accelerating.

As disclosed herein, panels with increased exposure require stiffening material applied to their back surfaces to resist the warpage caused by increased temperature. The siding member disclosed herein must also have the stiffening material uniformly applied across the back surface of the siding panel, with no gaps or voids in the coverage of the stiffening material. To reduce the potential for warpage, the stiffening material must fully occupy, for example, the volumes of the upward and downward facing extensions 28, 44, 50 of the siding panel 14.

Figure 8:
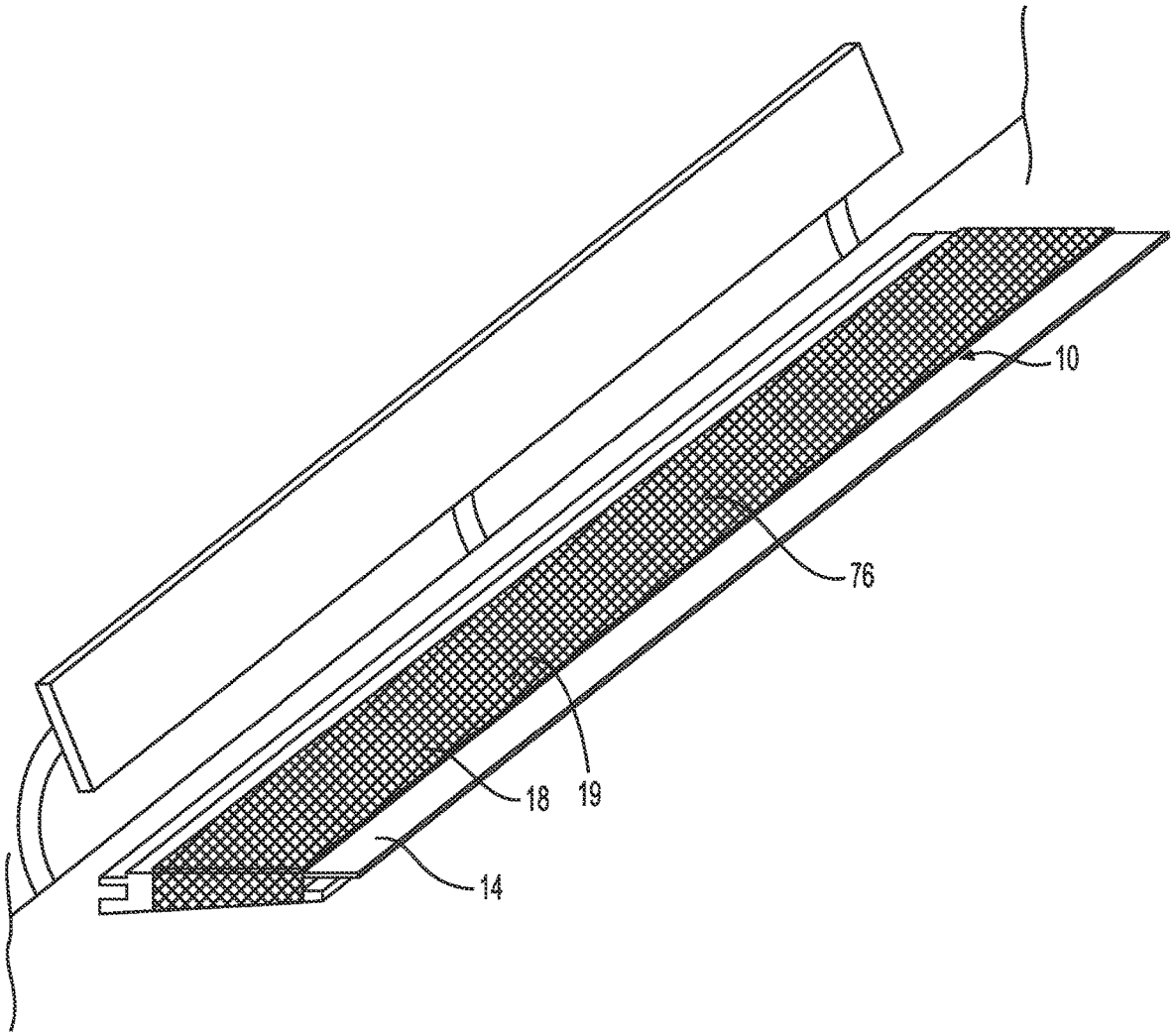
FIG. 8 illustrates the placement of a reinforcing mat adjacent the backside of the panel prior to filling with stiffening material.
Figure 9:
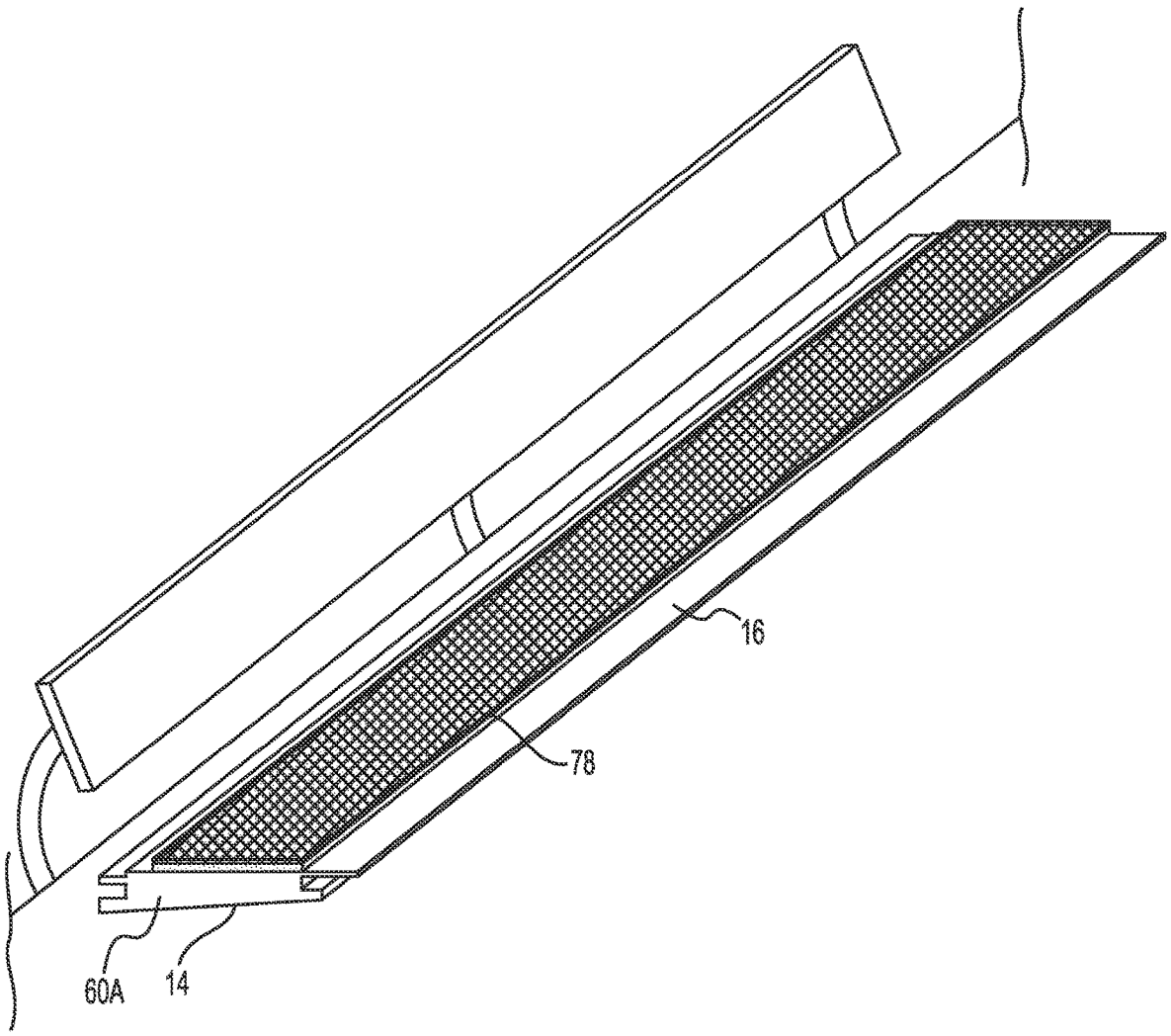
FIG. 9 illustrates the placement of a reinforcing mat atop the uncured stiffening material prior to the commencement of the curing process.

As seen in FIG. 8, prior to pouring or spraying the resin based stiffening material 60A into the receptacle 19 of the panel 14, a reinforcement mat 76 may optionally be laid atop the rear face 18 of the siding panel 14. Also, as seen in FIG. 9, as an optional further enhancement of the stiffening material 60A a reinforcement mat 78 may be laid atop the stiffening material 60A prior to curing of the stiffening material. The reinforcement mats 76, 78 may optionally be comprised of, for example, woven fiberglass, non-woven fiberglass or non-glass fibers. This recitation of specific reinforcement mat materials should not be considered limiting as to the options available under this disclosure.

The pouring or spraying of the stiffening material into the receptacle 19 is performed using equipment that is well known in the industry and therefore is not detailed further in this disclosure. Additionally, no adhesive material is preliminarily applied to the rear face 18 of the panel 14 prior to the insertion of the reinforcement mat 76, should one be employed. Moreover, an adhesive material is also not utilized if a reinforcement mat 76 is not utilized and the stiffening material 60A is poured or sprayed directly upon the rear face 18. The poured or sprayed stiffening material 60A bonds directly to the rear face 18 and all thermoplastic panel 14 surfaces that the stiffening material contacts without the need to apply any adhesive material to the surfaces of the panel 14.

Figure 10:
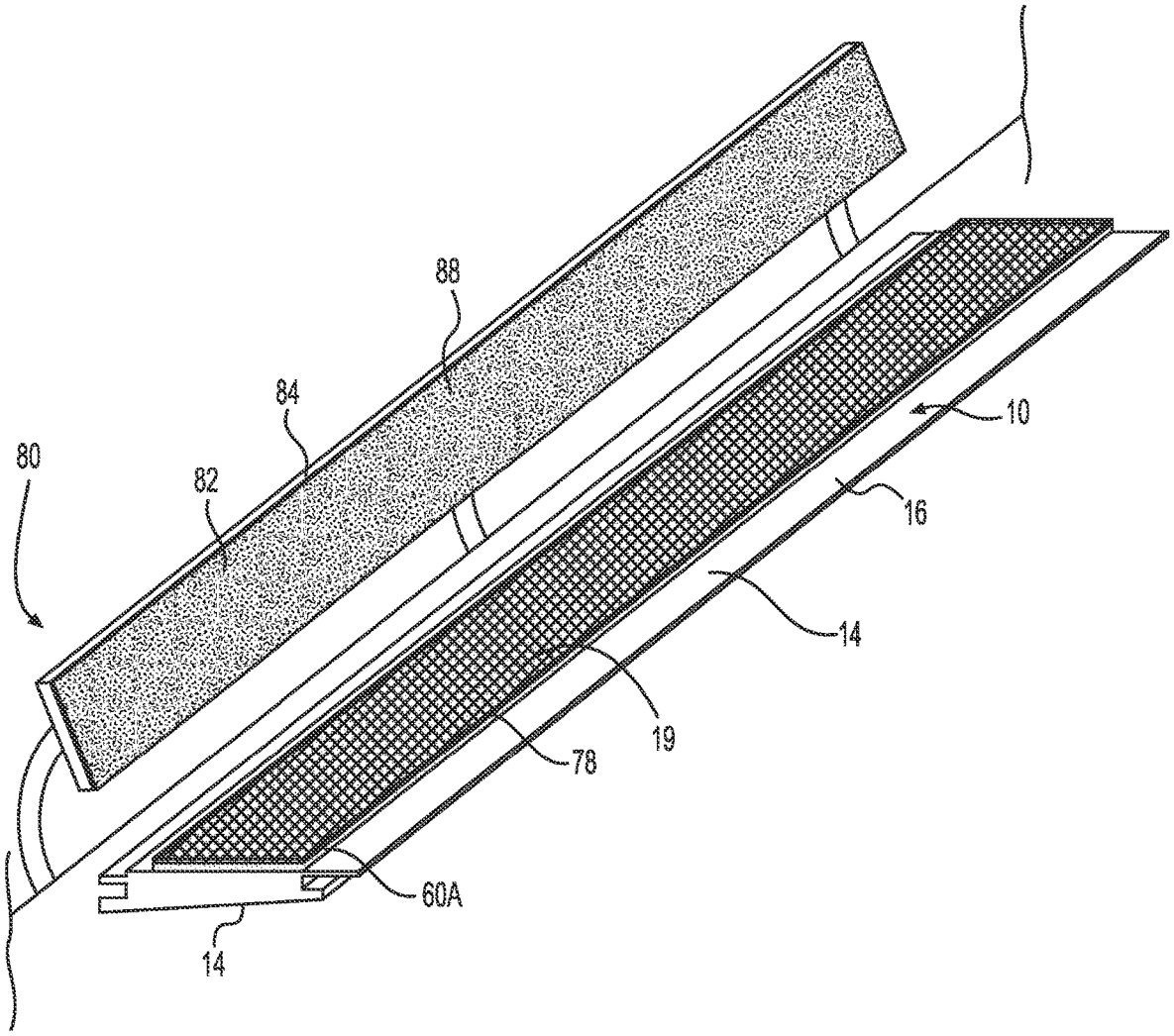
FIG. 10 illustrates the siding member with uncured stiffening material at the curing station prior to a closure of a platen.
Figure 11:
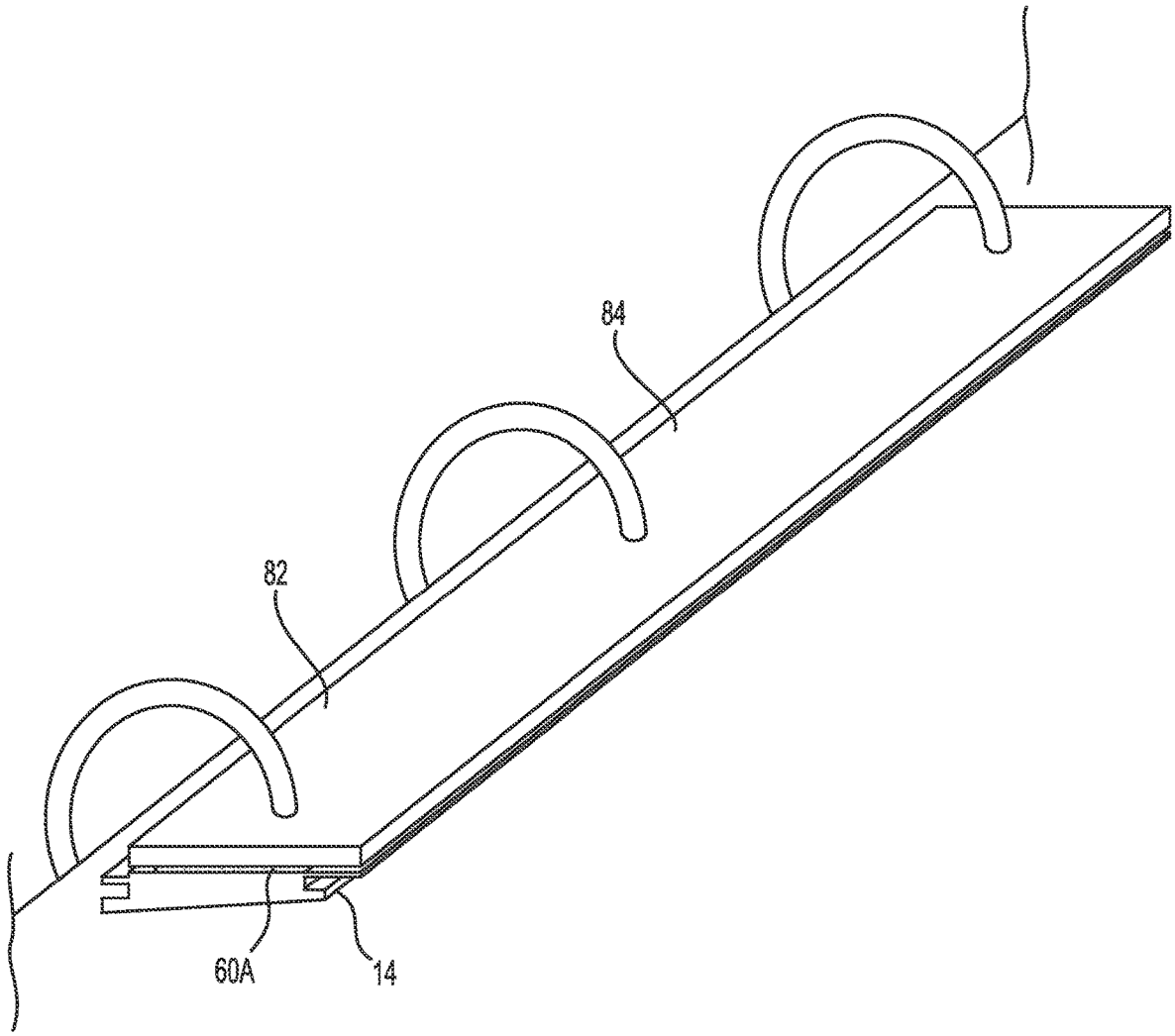
FIG. 11 illustrates the siding member at the curing station with the platen in position over the stiffening material for purposes of curing the stiffening material.

In fabricating the disclosed siding member 10, the uncured resin 60A after being poured or sprayed into the receptacle area 19 of the siding panel 14, the siding member 10 with or without the incorporation of reinforcement mats 76, 78 is moved to a curing station 80 as seen in FIG. 10. At the curing station 80 the uncured resin 60A is covered, as shown in FIG. 11, with a curing member 82 that could include, for example, any of a platen, a plate 84 or a belt. The curing member 82 evenly applies a pressure of preferably between 4 and 25 psi to the surface 70 of the resin 60A while maintaining a temperature above 130° F. for a period in the range of about 3 to 10 minutes.

Once the curing process is completed the curing surface 82 is withdrawn from the cured resin 60. The curing surface 82 can be incorporated with mold release or a release film, such as Teflon, PTFE, PE and/or PP to help facilitate the separation of curing surface 82 from siding panel. The curing member 82 also facilitates the formation of the rain screen features 62 that extend outwardly from the back surface of the siding material and extend between the top edge 22 and the lower edge 26 of the siding member 10 to facilitate drainage of moisture when the siding member 10 is mounted to the exterior of the structure.

The curing surface 82 utilizes embossing features 88 capable of forming the rain screen features 62 on the rear face 70 of the siding material such that the rain screen feature 62 extends between the upper edge and the lower edge of the siding member. Once the resin is fully cured and bonded to the interior surface of the siding panel 14 the finished panel is ready for installation onto the exterior of a structure.

Figure 12:
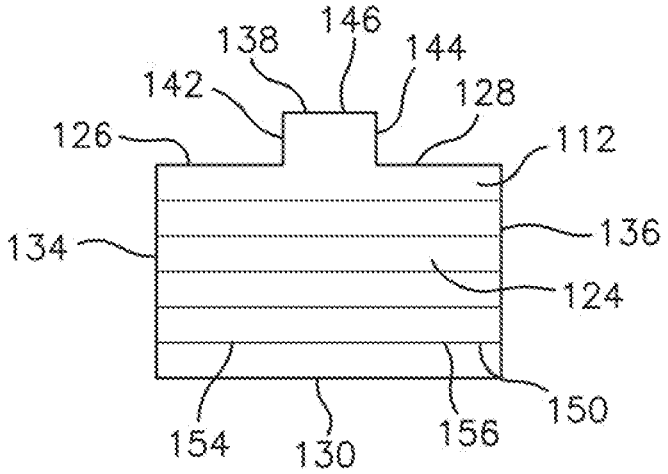
FIG. 12 illustrates an embodiment of the mending plate.
Figure 13:
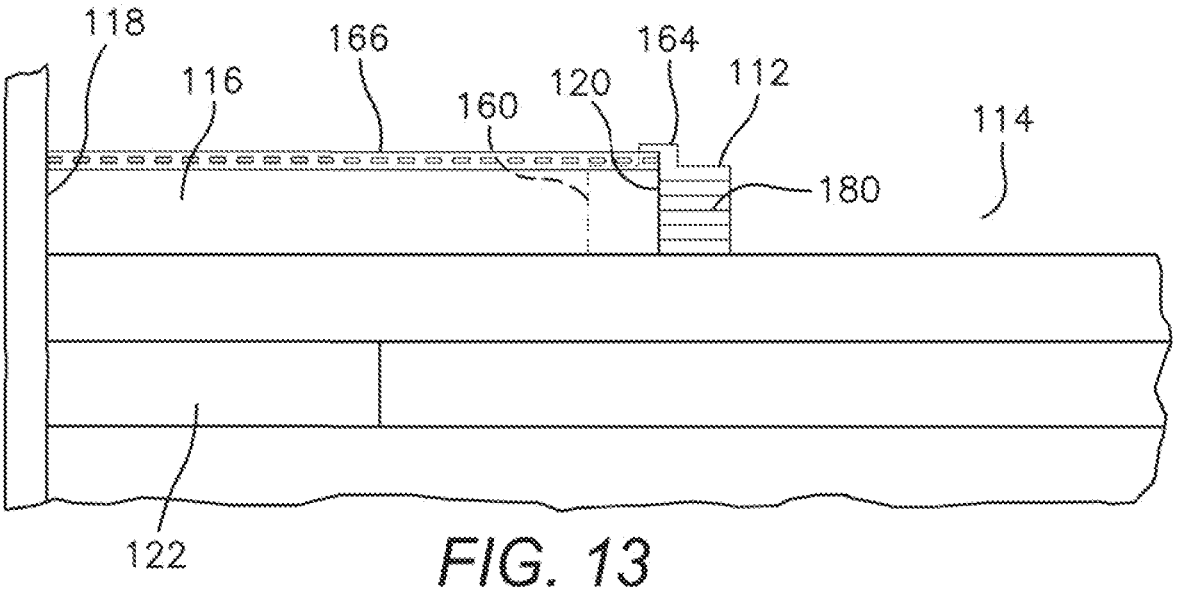
FIG. 13 illustrates the placement of an embodiment of the mending plate positioned beneath a single installed siding panel.

FIG. 12 illustrates a first embodiment of a mending plate 112 in isolation. FIG. 13 illustrates the placement of the mending plate 112 on the surface of the structure 114. The mending plate is a metal sheet, preferably aluminum flashing with a thickness in the range of about 0.015 to 0.025 inches. The mending plates may be of many different dimensions; however, the preferred dimensions of the plate are 8 inches by 10 inches. Both larger and smaller mending plate dimensions are contemplated by this disclosure. The mending plate 112 overall is slightly taller than the height of a siding panel. The first siding panel 116 is positioned with a first end 118 and a second end 120 proximate an already installed plurality of rows of siding panels 122.

The first row of siding generally begins at the lowermost area of the building structure to be protected by the panels. The mending plate 112 includes a front surface 124, a rear surface 126, an upper edge 128, a lower edge 130, first and second sides 134, 136 and a tab 138 extending upwardly from the upper edge 128 and disposed approximately midway between the first and second sides 134, 136, the tab 138 having a first vertical edge 142, a second vertical edge 144 and an upper edge 146.

The mending plate 112 has pre-marked parallel lines 150 that span between the first and second sides 134, 136 of the mending plate. The pre-marked lines 150 provide a guide for application of a bead 154 of adhesive 156 across the span of the mending plate 112. A total of five lines spanning between the two sides of the mending plate 112 is a preferred embodiment; however, a lesser or a greater number of lines 150 are contemplated by this disclosure or even no lines at all. An exemplary adhesive 156 for use with the mending plates 112 and the siding panels 116, 122 is a two-part methyl methacrylate. Other adhesives are also contemplated by this disclosure and with appropriate chemistry can function effectively. The mending plate 112, or at least the front surface 124 of the mending plate, is preferably coated prior to application of the adhesive 156 to improve the chemical bond. Experimentation with a variety of coatings revealed that a low mar coating yielded the most desirable results relative to the tensile and shear strength bond between the adhesive 156 and the mending plate 112. The low mar coating enhances the ability of the adhesive 156 to bond to the front surface 124 of the mending plate 112.

Once the adhesive 156 beads 154 are applied to the lines 150 on the mending plate 112 approximately one-half of the mending plate 112 is positioned beneath the second end 120 of the first siding panel 116 as seen in FIG. 13. The outline 160 illustrated in FIG. 13 provides an indication of the portion of the mending plate 112 that is covered by the siding panel 116. An upper portion 164 of the tab 138 extends above the upper surface 166 of the siding panel 116. Once the mending plate 112 and the first siding panel 116 are in position the first siding panel 116 is secured in position by passing fasteners through the nail hem 170 of the siding panel 116 with a spacing that is preferably about 16 inches as seen in FIG. 14.

The installer presses firmly on the first siding panel 116 in an area over the mending plate 112 to spread the underlying adhesive 156 to the backside of the siding panel 116. The spreading of the adhesive 156, under pressure, serves to enhance the chemical bond of the siding panel 116 to the mending plate 112. Sanding of the exposed surface 70 of the cured resin stiffening material 60A, as illustrated at FIG. 2, results in an improved chemical bond with the adhesive 156. The objective of the sanding process is to de-gloss the surface 70 and expose the pores of the cured resin 60A. This de-glossing allows the adhesive 156 to migrate into the pores and thereby increasing the chemical bond strength once the adhesive is cured. The exposed surface 70 of the cured resin stiffening material 60A is preferably sanded with 80-grit sandpaper to achieve the desired de-glossed surface.

Figure 14:
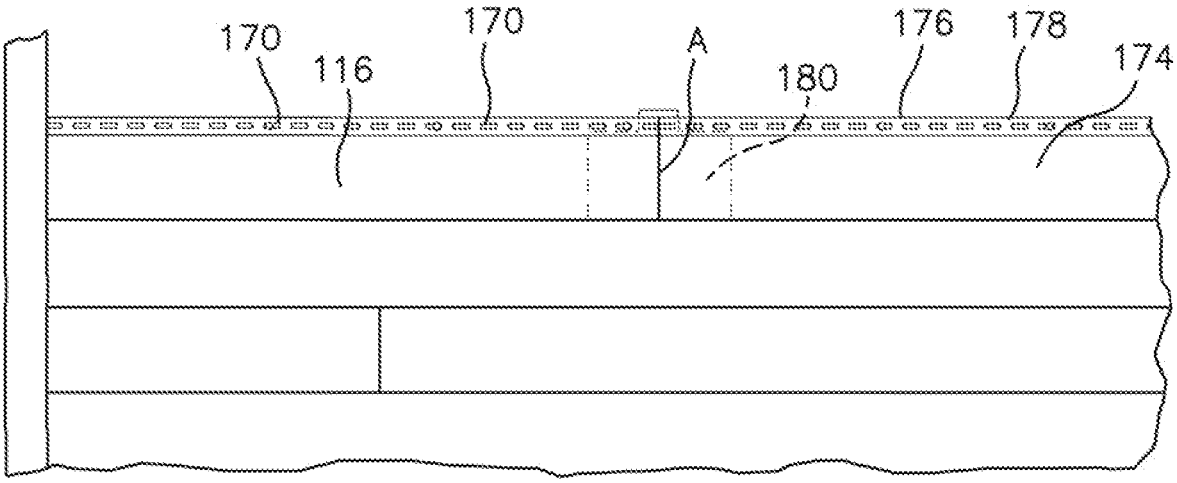
FIG. 14 illustrates the placement of an embodiment of the mending plate positioned beneath two installed siding panels.

Following the application of manual pressure to the siding panel 116 over the mending plate 112 a second siding panel 174, as seen in FIG. 14 is positioned adjacent the first siding panel 116. The installer tightly abuts the two panels 116, 174 at "A" and passes fasteners 176 through the nail hem 178 of the second siding panel 174, in conformance with manufacturer's instructions, so as not to lock the siding panel 174 in position thereby preventing it from expanding and contracting during thermal cycles. Once the fasteners are installed, pressure is applied to the portion of the siding panel 174 that overlaps the second side 180 of the mending plate 112. This procedure, as previously noted, spreads the beads 154 of adhesive deposited onto the mending plate across the surface of both the mending plate 112 and the back of the siding panel 174.

The utilization of mending plates 112 at each end edge of the siding panels provides a mechanism to eliminate, or at least greatly reduce the potential for separation of the ends of the abutting siding panels resulting an aesthetically undesirable gap. The mending plate 112 secures the ends of the opposed siding panels together with a strong and unrelenting bond that maintains a visually pleasing appearance of the siding installation. Once each horizontally disposed course is completed the installer proceeds to install the next course atop the previously installed course. The method of installing the next course of the siding panels is well known in the industry as the panels are configured to allow the upper course to be inserted into the lower course thereby locking them together in a stack lock configuration.

The kit as disclosed herein includes the siding panels 116, 122, 174 as previously described, the mending plate 112 and adhesive 156. Fasteners 176, for passing through the nail hem of the panels, may optionally be included in the kit.

Figure 15:
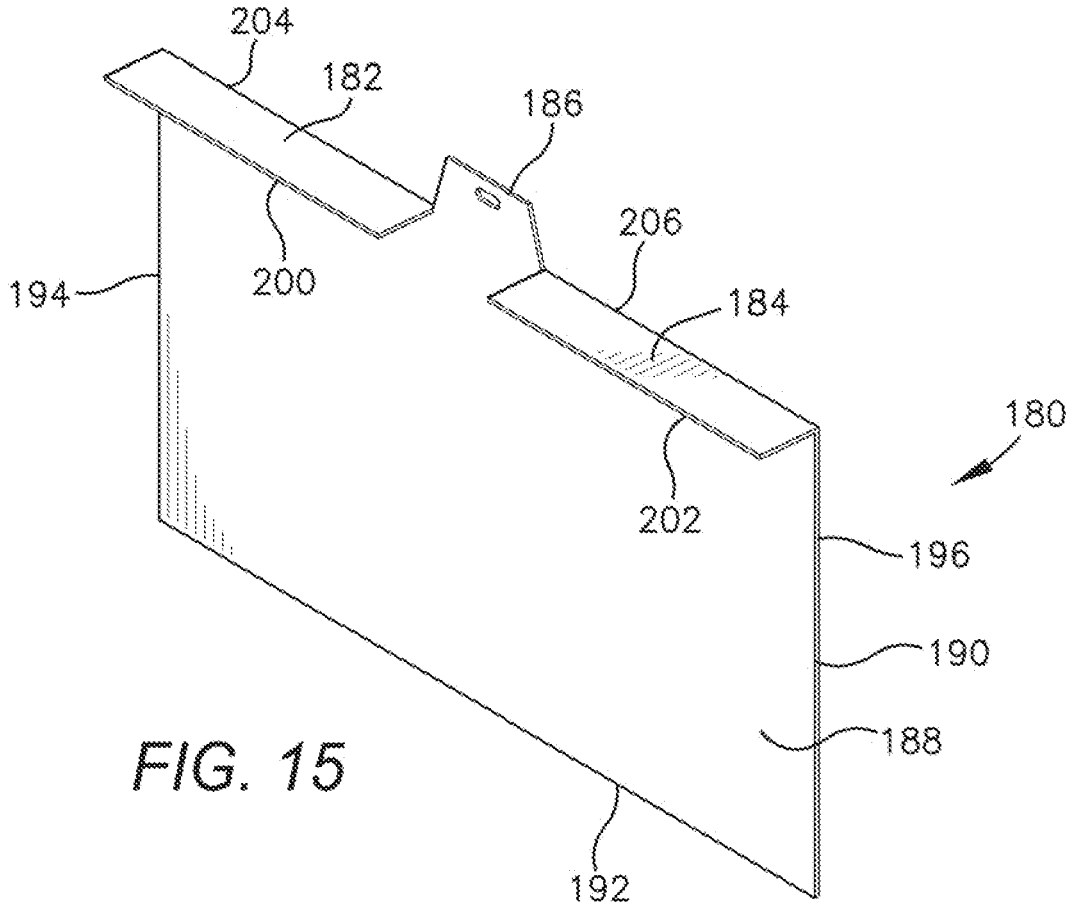
FIG. 15 illustrates a perspective view of an alternative embodiment of the mending plate incorporating flaps on each side of the tab.
Figure 16:
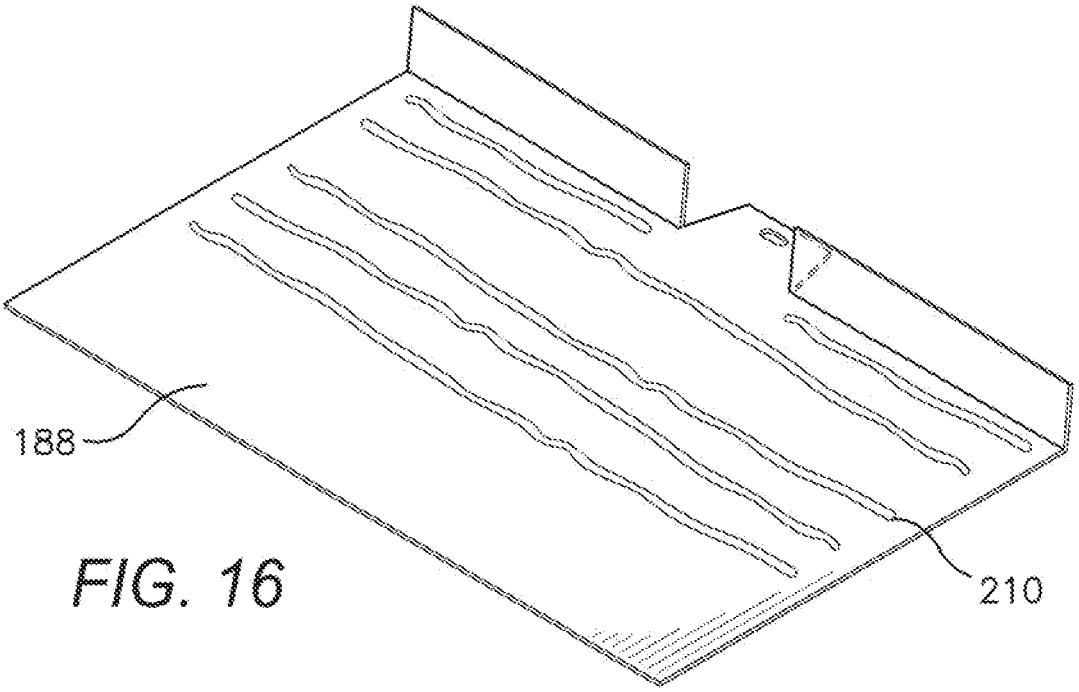
FIG. 16 illustrates a perspective view of an alternative embodiment of the mending plate incorporating flaps on each side of the tab with lines of adhesive applied to the backside of the mending plate.

A second embodiment of a mending plate 180 is illustrated at FIG. 15. This mending plate 180 incorporates a flap 182, 184 on each side of the tab 186. The mending plate as previously detailed also includes a front surface 188, a rear surface 190, a lower edge 192 and opposed side edges 194, 196. The flaps 182, 184 also include outer edges 200, 202. The flaps 182, 184 extend outwardly from bend lines 204, 206 in the range of about 0.5 to 2.0 inches. FIG. 6 illustrates the application of an adhesive 210 that is preferably a two-part methyl methacrylate adhesive; however, other compositions of adhesives are also contemplated by this disclosure. The specific pattern of application of the adhesive 210 is as illustrated in FIG. 16 is preferred; however, other configurations may also provide the requisite adhesion. The adhesive 210 is only applied to the front surface 188 of the mending plate 180.

Figure 17:
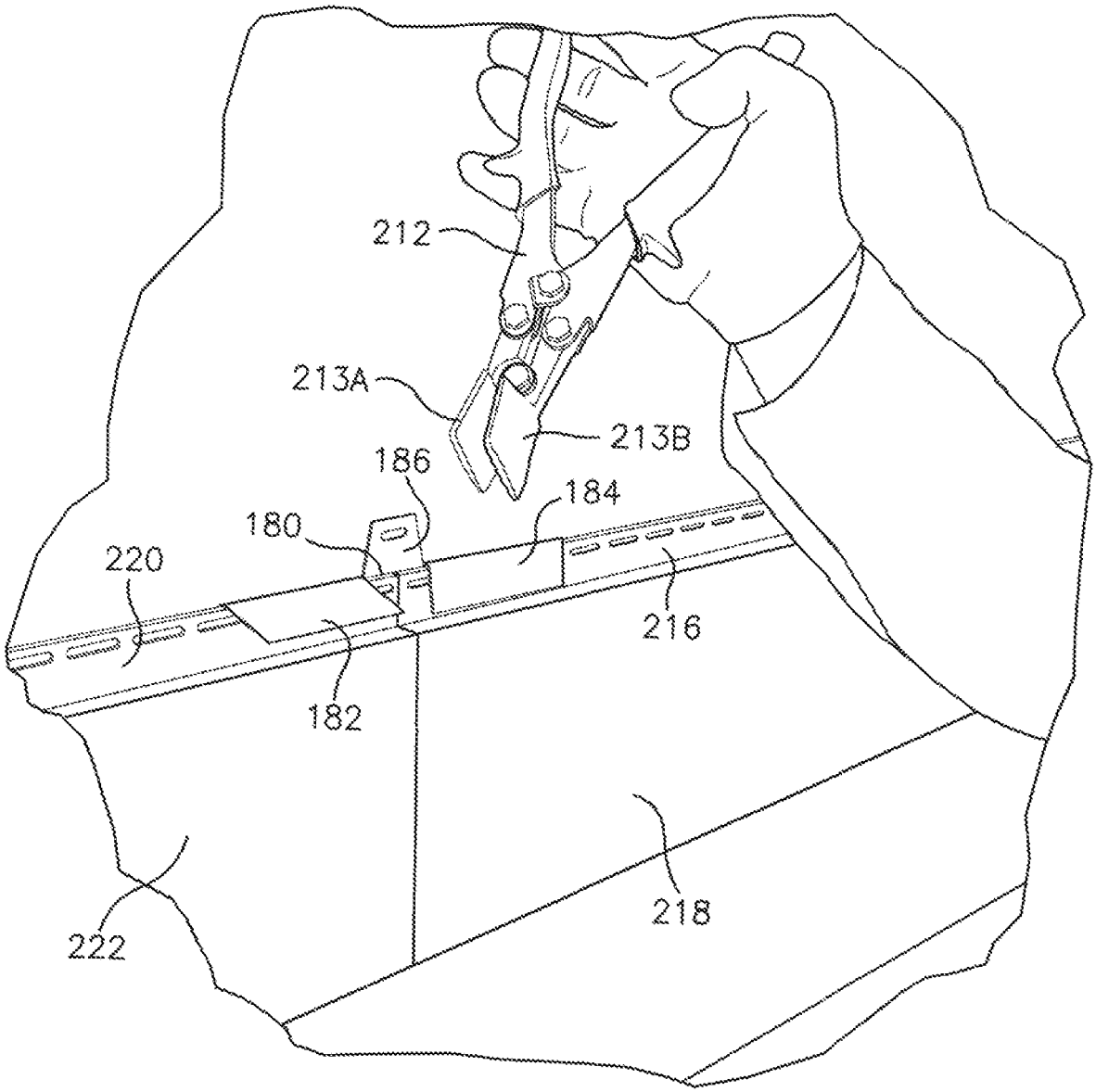
FIG. 17 illustrates a folding of a flap of an installed mending plate over the nail hem of a siding panel member with a crimping tool.

FIG. 17 illustrates the utilization of an industry standard sheet metal tool 212, with flat plates 213A, 213B for crimping the flap 184. The flap 184 is crimped over the upwardly extending nail hem 216 to hold the mending plate 180 tightly to the nail hem 216 and to secure the siding panel 218 in position. The same procedure with the crimping tool 212 is contemplated on the second flap 182. The second flap 182 is tightly folded over the nail hem 220, effectively locking the mending plate 180 and the siding panel 222 together.

Figure 18:
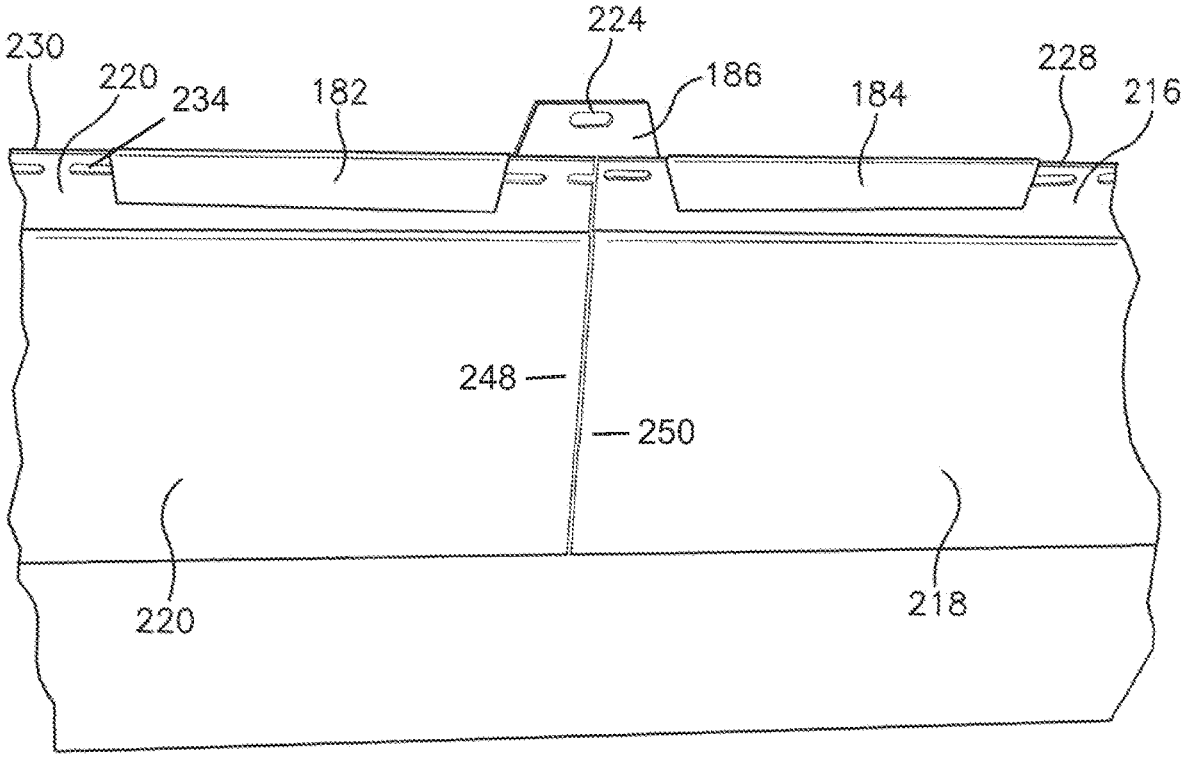
FIG. 18 illustrates both flaps of the mending plate in folded over position onto the nail hem.

FIG. 18 illustrates the fully assembled siding panels 218, 222 and mending plate 180 in a final configuration. The tab 186, with a through hole 224 extends upwardly beyond the upper edges 228, 230 of the nail hems 216, 220. This embodiment of the mending plate 180 facilitates the migration of adhesive 210 through the openings 234 in the nail hems 216, 220 because of the pressure applied to the flaps 182, 184 by the crimping tool 212. Once the adhesive 210 fully cures it effectively locks the nail hems 216, 220 of the two siding panels 218, 222 together preventing separation, and the formation of a gap, at the ends 248, 250 of the two panels.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

We claim:

1. A method for installing siding panels to an exterior surface of a structure, the method comprising:

positioning a first siding panel with a first end and a second end proximate a lowermost exterior surface of the structure requiring an installation of siding;

selecting a mending plate, the mending plate comprising a front surface, a rear surface, an upper edge, a lower edge, a first and second side edge and a tab extending upwardly from the upper edge and disposed approximately midway between the first and second sides edges, the tab having a first vertical edge, a second vertical edge and an upper edge;

applying a plurality of lines of adhesive parallel to the lower edge of the mending plate, the adhesive spanning between the first and second sides edges;

inserting the mending plate beneath the second end of the first siding panel, the mending plate insertion extending approximately one half the distance between the first and second sides of the mending plate, a portion of the tab extending above the upper edge of a thermoplastic skin of the first siding panel;

securing the first siding panel in position with fasteners passing through a nail hem as well as the tab of the mending plate and into the exterior surface of the structure;

positioning a first end of a second siding panel adjacent the second end of the first siding panel;

securing the first end of the second siding panel in position over the mending plate with fasteners passing through a nail hem of the second siding panel and into the exterior surface of the structure.

2. The method of claim 1, wherein the mending plate is a flashing material.

3. The method of claim 2, wherein the flashing material is aluminum.

4. The method of claim 1, wherein the mending plate has pre-marked lines identifying the location for application of the adhesive.

5. The method of claim 1, wherein the adhesive is applied in a bead of a width of approximately 0.25 inches.

6. The method of claim 1, wherein the step of positioning the first end of the second siding panel adjacent the second end of the first siding panel comprises abutting the adjacent siding panels against one another.

7. The method of claim 1, wherein a first and second flap are disposed opposite one another with each flap extending from the tab to the first and second side edges respectively.

8. The method of claim 7, wherein the first and second flaps fold respectively along a first-fold line and a second-fold line.

9. A method for installing siding panels to an exterior surface of a structure, the method comprising:

selecting a first siding panel for installation, the first siding panel comprising:

(i) a thermoplastic skin with an upper edge, a lower edge, a front face, a rear face, wherein the rear face is generally shaped to provide a receptacle capable of retaining a liquid material and a nail hem with a front face and a rear face, the nail hem disposed above the receptacle when the first siding panel covers the exterior surface of the structure;

(ii) a first extension with a volume and a first channel located at the upper edge of the first siding panel, the first channel comprising a first and second wall and a bottom surface, the second wall of the first channel formed by the front face of the nail hem;

(iii) a second extension with a volume and a second channel located at the lower edge of the first siding panel, wherein the first extension and the first channel are configured for cooperative engagement with a second extension and second channel of a superjacent siding panel; and (iv) a resin based stiffening material filling the receptacle wherein the resin based stiffening material forms a back surface that faces the exterior surface of the structure when the first siding panel is installed thereon;

positioning the first siding panel with a first end and a second end proximate a lowermost exterior surface of the structure requiring an installation of siding;

selecting a mending plate, the mending plate comprising a front surface, a rear surface, an upper edge, a lower edge, first and second side edges, a tab extending upwardly from the upper edge and disposed approximately midway between the first and second side edges, and first and second flaps, the first and second flaps disposed opposite one another from the tab and bent along a bend line;

applying a plurality of lines of adhesive parallel to the lower edge of the mending plate, the adhesive spanning between the first and second side edges;

inserting the mending plate beneath the second end of the first siding panel, the mending plate insertion extending approximately one half the distance between the first and second side edges of the mending plate, a portion of the upwardly extending tab extending above the upper edge of the thermoplastic skin of the first siding panel;

securing the first panel in position with fasteners passing through the nail hem as well as the upwardly extending tab of the mending plate and into the exterior surface of the structure;

positioning a first end of a second siding panel adjacent the second end of the first siding panel;

securing the first end of the second siding panel in position over the mending plate with fasteners passing through the nail hem and into the exterior surface of the structure.

10. A siding system kit, comprising:

a first and second siding panel each with an upper edge:

a mending plate comprising a front surface, a rear surface, a lower edge, first and second side edges, an upwardly extending tab disposed approximately midway between the first and second side edges, and a pair of folded-over flaps oppositely disposed from one another by the tab;

an adhesive for application to the mending plate, wherein a plurality of lines of the adhesive are applied across the front surface of the mending plate; wherein the first siding panel is positioned against a surface of a building structure and approximately one half of the span between the first and second side edges of the mending plate is disposed beneath a second end of the first siding panel with the remainder beneath a first end of the second siding panel that abuts the second end of the first siding panel, wherein each of the flaps are crimped onto a separate nail hem extending upwardly from each of the first and second siding panels and fasteners are passed through the nail hems of the first and second siding panels securing the first and second siding panels in position against the surface of the structure.

11. The siding system kit of claim 10, wherein a portion of the tab of the mending plate extends above the upper edge of the first and second siding panels.

12. The siding system kit of claim 10, wherein the adhesive applied to the mending plate adheres to a rear surface of the first and second siding panels adjacently disposed to one another.

13. The siding system kit of claim 10, wherein the adhesive is a two-part methyl methacrylate adhesive.

14. The siding system kit of claim 10, wherein once the adhesive cures, the adhesive in combination with the mending plate prevent separation of the second end of the first siding panel from the first end of the second siding panel.

15. The siding system kit of claim 14, wherein no appreciable gap occurs between the second end of the first panel and the first end of the second panel due to thermal fluctuations.

16. The siding system kit of claim 10, wherein the thickness of the mending plate is in the range of 0.015 to 0.025 inches.

17. A siding system kit, comprising:

a first and second siding panel that each comprise:

(i) a thermoplastic skin having a first and second end, an upper edge, a lower edge, a front face, a rear face, wherein the rear face is generally shaped to provide a receptacle capable of retaining a liquid material and a nail hem, the nail hem disposed a distance away from the receptacle, the nail hem including a front face and a rear face;

(ii) a first extension and a first channel located at an upper edge of the thermoplastic skin, the first channel comprising a first and second wall and a bottom surface, the second wall of the first channel formed by the front face of the nail hem;

(iii) a second extension and a second channel located at a lower edge of the thermoplastic skin, wherein the first extension and the first channel are configured for cooperative engagement with a second extension and a second channel of a superjacent siding panel; and (iv) a resin based stiffening material filling the receptacle wherein the resin based stiffening material has an isocyanate index of less than 150 and the resin based stiffening material is cured in position under pressure with a heated curing surface; and a mending plate comprising a front surface, a rear surface, a lower edge, first and second side edges;

an adhesive for application to the mending plate; wherein multiple lines of the adhesive are applied across the front surface of the mending plate; wherein the first siding panel is positioned against a surface of a building structure and approximately one half of the span between the first and second side edges of the mending plate is disposed beneath the second end of the first siding panel with the remainder beneath the first end of the second siding panel that abuts the second end of the first siding panel, first and second flaps of the mending plate folded over respectively a first and second nail hem of the first and second siding panels, wherein fasteners are passed through the nail hems of the first and second siding panels securing the first and second siding panels in position against the surface of the binding structure.

18. The siding system kit of claim 17, wherein an exposed surface of the resin based stiffening material is abraded to de-gloss the exposed surface.

19. The siding system kit of claim 18, wherein the exposed surface is abraded with 80-grit sandpaper.

20. The siding system kit of claim 17, wherein at least the front surface of the mending plate is coated to improve the adhesion between the adhesive and the front surface of the mending plate.

21. The siding system kit of claim 20, wherein the mending plate is coated with a low mar coating product.

* * * * *